US008851316B2

(12) United States Patent
Barrett et al.

(10) Patent No.: US 8,851,316 B2
(45) Date of Patent: Oct. 7, 2014

(54) TRASHCAN LINER DISPENSER

(76) Inventors: Donald R. Barrett, Lincoln, NE (US); Richard J. Baranowski, Scottsdale, AZ (US)

( * ) Notice: Subject to any disclaimer, the term of this patent is extended or adjusted under 35 U.S.C. 154(b) by 237 days.

(21) Appl. No.: 13/486,254

(22) Filed: Jun. 1, 2012

(65) Prior Publication Data

US 2012/0234836 A1 Sep. 20, 2012

Related U.S. Application Data

(63) Continuation-in-part of application No. 12/191,241, filed on Aug. 13, 2008, now Pat. No. 8,210,386, which is a continuation-in-part of application No. 11/067,215, filed on Feb. 25, 2005, now abandoned, and a continuation-in-part of application No. 11/318,356, filed on Dec. 22, 2005, and a continuation-in-part of application No. 11/358,013, filed on Feb. 21, 2006, now abandoned, and a continuation-in-part of application No. 11/412,234, filed on Apr. 25, 2006, now abandoned.

(51) Int. Cl.

| | |
|---|---|
| ***B65D 25/14*** | (2006.01) |
| ***A47K 10/24*** | (2006.01) |
| ***B65D 85/00*** | (2006.01) |
| ***B65F 1/06*** | (2006.01) |

(52) U.S. Cl.

CPC ..... *B65F 1/062* (2013.01); *B65F 2220/12* (2013.01)

USPC ..... 220/495.07; 221/46; 206/389

(58) Field of Classification Search

CPC ... B65F 1/062; B65F 2220/12; A47K 10/424; A47K 10/425; A47K 10/421; A47K 10/427; B65D 83/0805; B65D 83/0817; B65D 83/0894; Y10S 220/908

USPC ..... 220/495.07, 553, 676, 908, 908.1; 221/46, 49, 197; 206/389, 390, 395, 206/409, 494, 554, 499

See application file for complete search history.

(56) References Cited

U.S. PATENT DOCUMENTS

| | | | | |
|---|---|---|---|---|
| 3,624,791 | A * | 11/1971 | Taub | 221/59 |
| 4,349,123 | A * | 9/1982 | Yang | 220/495.07 |
| 4,721,226 | A | 1/1988 | Yurko | |
| 4,850,507 | A * | 7/1989 | Lemongelli et al. | 220/495.07 |
| 5,372,272 | A | 12/1994 | Jennings | |
| 5,405,041 | A | 4/1995 | Van Brackle | |
| 5,458,259 | A | 10/1995 | Falk | |
| 5,462,197 | A * | 10/1995 | Pound | 221/46 |
| 5,503,292 | A | 4/1996 | Cuccharia | |
| 5,509,570 | A | 4/1996 | DeMatteis | |
| 5,628,424 | A | 5/1997 | Gola | |
| 5,632,401 | A | 5/1997 | Hurd | |
| 5,655,682 | A | 8/1997 | Hoffrichter | |

(Continued)

FOREIGN PATENT DOCUMENTS

GB 2266446 A 11/1993

*Primary Examiner* — Bryon Gehman
*Assistant Examiner* — Shawn M Braden
(74) *Attorney, Agent, or Firm* — Harold I. Masteller

(57) ABSTRACT

A trashcan liner dispenser that comprises a combination caddy and liner cartridge that self-locks together when nested, the caddy including an arrangement whereby an access opening in the liner cartridge cooperates with a supply of folded liners housed therein to reduce the pulling force required to remove a liner from the nested cartridge.

11 Claims, 8 Drawing Sheets

(56) References Cited

U.S. PATENT DOCUMENTS

| | | | | |
|---|---|---|---|---|
| 5,671,847 | A | 9/1997 | Pedersen et al. | |
| 5,730,312 | A | 3/1998 | Hung | |
| 5,857,586 | A * | 1/1999 | Scherr | 221/45 |
| 6,105,859 | A | 8/2000 | Stafford | |
| 6,123,215 | A | 9/2000 | Windle | |
| 6,126,031 | A | 10/2000 | Reason | |
| 6,568,555 | B1 | 5/2003 | LoCascio | |
| 6,736,287 | B2 * | 5/2004 | Sauer et al. | 221/283 |
| 6,827,017 | B2 * | 12/2004 | Elia et al. | 101/483 |
| 7,036,675 | B2 | 5/2006 | Forest | |
| 7,093,737 | B2 * | 8/2006 | Tramontina et al. | 221/46 |
| 7,121,426 | B2 * | 10/2006 | Runnels | 221/2 |
| 2003/0010669 | A1 * | 1/2003 | Simhaee | 206/554 |
| 2004/0217121 | A1 | 11/2004 | Geyer | |
| 2005/0220368 | A1 * | 10/2005 | Kohn | 383/9 |
| 2005/0258177 | A1 * | 11/2005 | Woodson | 220/495.07 |

* cited by examiner

Fig. 8
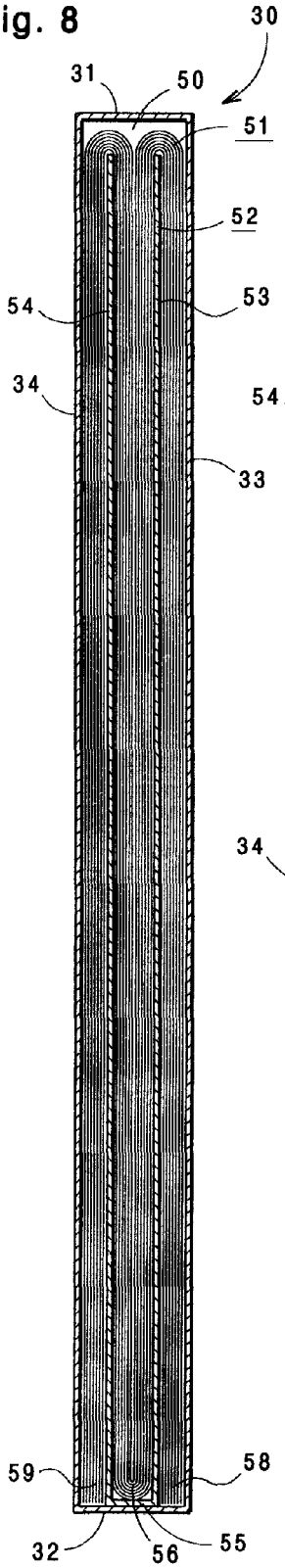
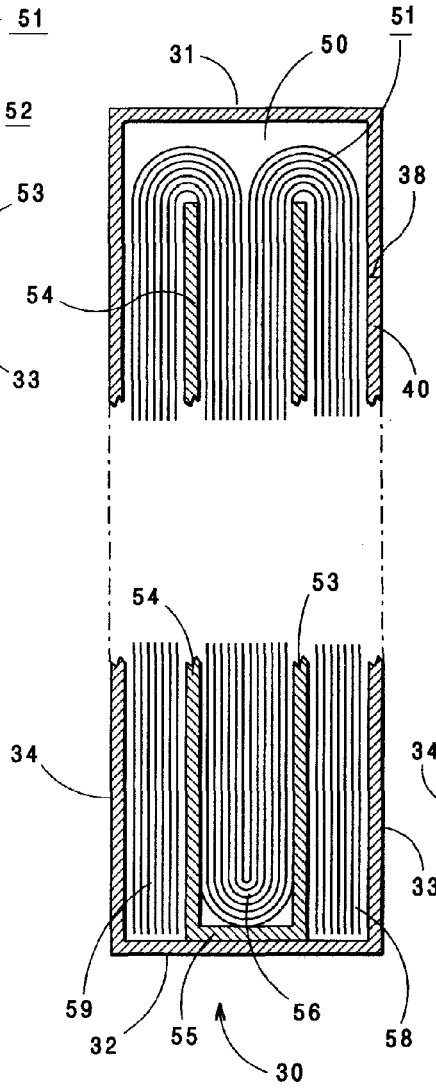
Fig. 9
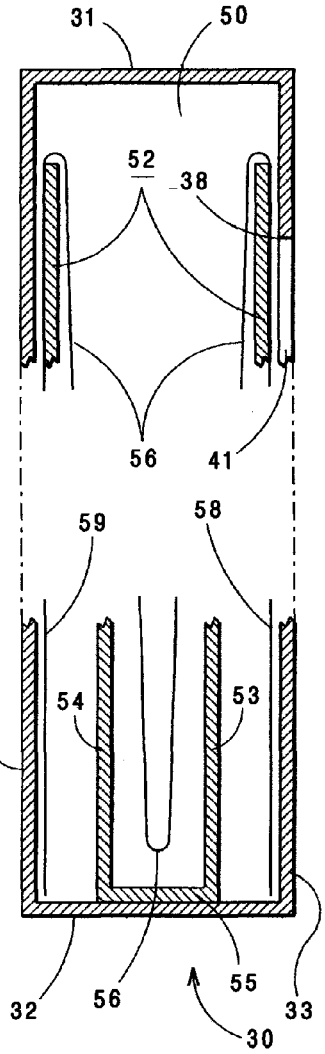
Fig. 10

TRASHCAN LINER DISPENSER

This application is a continuation-in-part of U.S. application Ser. No. 12/191,241 filed Aug. 13, 2008 which is a continuation-in-part of the following four applications: (1) U.S. application Ser. No. 11/067,215 filed Feb. 25, 2005 now abandoned, (2) U.S. application Ser. No. 11/318,356 filed Dec. 22, 2005 now abandoned, (3) U.S. application Ser. No. 11/358,013 filed Feb. 21, 2006 now abandoned, and (4) U.S. application Ser. No. 11/412,234 filed Apr. 25, 2006 now abandoned.

BACKGROUND

The present invention is directed to the collection and disposal of waste materials such as garbage and trash, and in particular, it is directed to a combination retrofit caddy or pouch assembly and cartridge that contains a supply of plastic liners or bags for use with trashcan or receptacle.

Trashcans or trash receptacles are often fitted with a plastic liner for sanitation purposes and for convenience when disposing of the collected waste. Therefore, it is desirable to have replacement bags stored within easy reach of the trashcan to provide ready access to a new liner after a filled liner is removed from the can. Various means for providing such ready access to trashcan liners are shown in the patents listed by applicant on his information disclosure statement (PTO/SB/08a) filed herewith. However, the listed patents fail to provide a combination retrofit caddy and liner cartridge with a self-interlocking mechanism that prevents withdrawal of the cartridge from the caddy when a liner is pulled from the cartridge. In addition, the listed patents also fail to teach suspending a supply of liners within a cartridge in an arrangement that places the open end of each liner adjacent an access opening.

BRIEF SUMMARY OF THE INVENTION

It is therefore the first object of the present invention to provide a combination retrofit caddy and cartridge to provide a trashcan liner dispenser that continuously places a first liner through a last liner at an access opening for use.

It is another object of the present invention to provide a combination caddy and cartridge whereby the cartridge contains a supply of liners suspended from a support means that positions the open end of the first liner through a last liner adjacent an access opening provided in the cartridge.

It is another object of the present invention to provide a self-interlocking caddy and cartridge whereby the nested cartridge is securely fixed within a pouch portion of the caddy when a liner pulled from the access opening provided in the cartridge.

It is another object of the present invention to provide a self-interlocking mechanism that neither contacts the supply of suspended liners nor interferes with pulling a liner from a cartridge interlocked with the caddy.

It is another object of the present invention to provide a retrofit caddy easily attached to any selected surface of a trashcan or receptacle, the pouch adapted to receive the cartridge containing a supply of liners.

It is another object of the present invention to provide a retrofit combination caddy and cartridge that can be positioned to prevent contact with liquids collected in a trashcan.

Specifically this invention is a retrofit trashcan liner supply system that provides a combination caddy and cartridge that contains a supply of liners for use within a trashcan.

One aspect of the present invention is a retrofit caddy adapted for attachment to any suitable surface of a trashcan selected by the user.

Another aspect of the present invention is a retrofit caddy that self-locks with the cartridge so that the cartridge cannot be detached when a liner is pulled from the cartridge.

Still another aspect of the present invention is a cartridge that contains a supply of liners suspended from a support means that positions the open end of the liners adjacent an access opening provided in the cartridge.

BRIEF DESCRIPTION OF THE DRAWINGS

FIG. 8 is a transverse cross-section view taken through the liner cartridge shown in FIG. 7.

FIG. 9 is an enlarged cross-section view of the cartridge shown in FIG. 8 filled with a plurality or supply of liners.

FIG. 10 is an enlarged cross-section view of the cartridge shown in FIG. 9 with a single remaining liner contained therein.

DETAILED DESCRIPTION OF THE INVENTION

The present invention includes a trashcan liner dispenser comprising a caddy or pouch assembly in combination with a liner cartridge, the combination including a self-locking mechanism that prevents detachment or accidental removal of the liner cartridge from the caddy when a liner is pulled from an access opening in the cartridge. The liner cartridge includes a supply of liners suspended from a support means that positions the open end of the suspended liners adjacent the access opening. The self-locking mechanism includes a lock pin that tears open, penetrates, and interlocks with the cartridge to prevent cartridge movement, the lock pin neither contacting the supply of suspended liners or interfering with pulling a liner from the interlocked cartridge.

As used herein, the term "lock pin" includes any suitably shaped prong or detent formed in the caddy to self-lock with a liner cartridge inserted into the pouch portion of the caddy.

The term "caddy" as used herein identifies a container or device for storing or holding objects.

The term "pouch" is used herein to identify a pocket or chamber formed in the "caddy" or pouch assembly, the "pouch" being shaped to receive an inserted or nested cartridge that contains trashcan liners.

The term "support member" as used herein refers to a structure housed within the cartridge that suspends a supply of folded trashcan liners in an arrangement of fourths.

Figure 1:
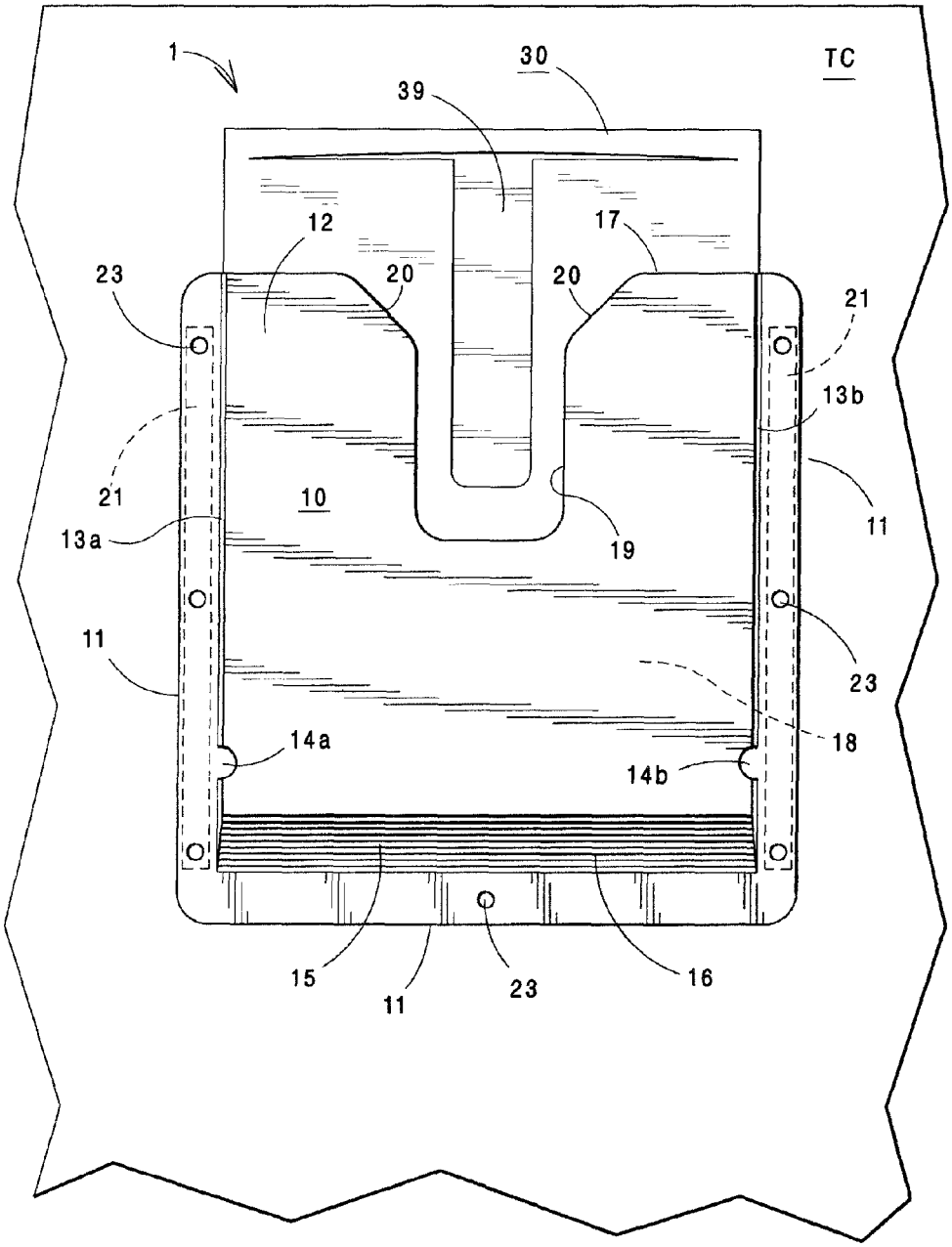
FIG. 1 is a front elevation view of a combination caddy or pouch assembly and cartridge fixed to a surface of a trashcan.
Figure 2:
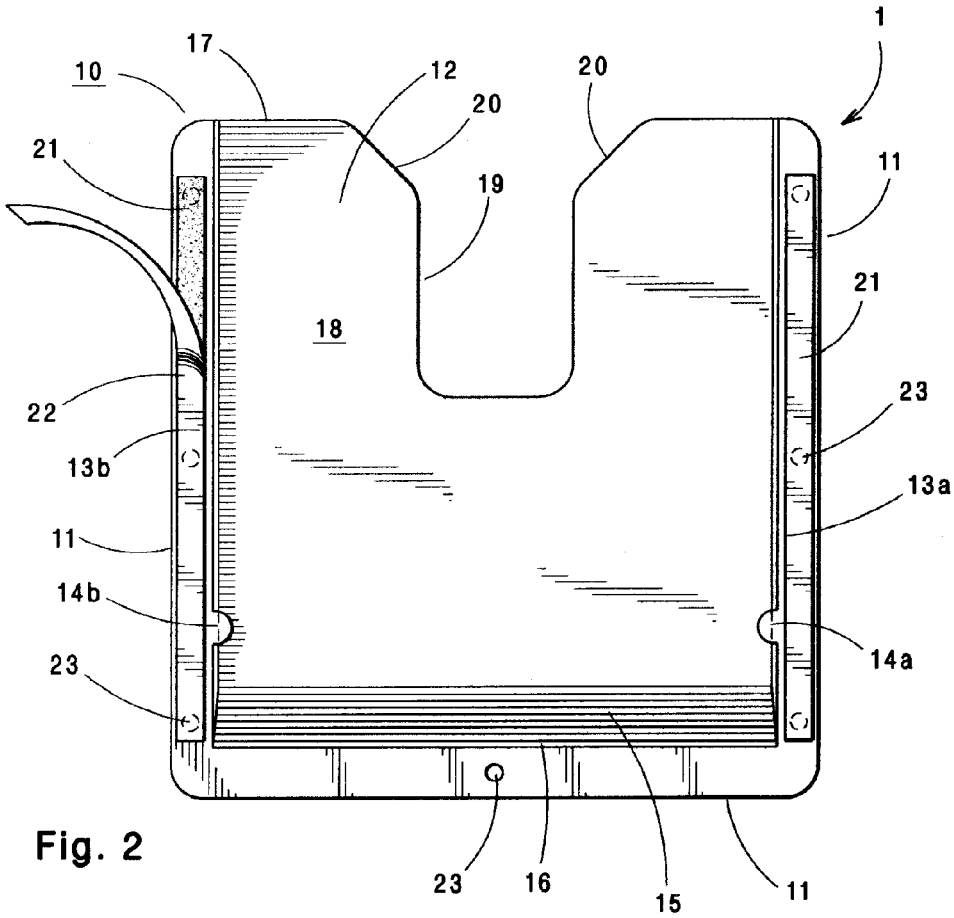
FIG. 2 is a back elevation view of the caddy shown in FIG. 1 with the cartridge removed.
Figure 3:
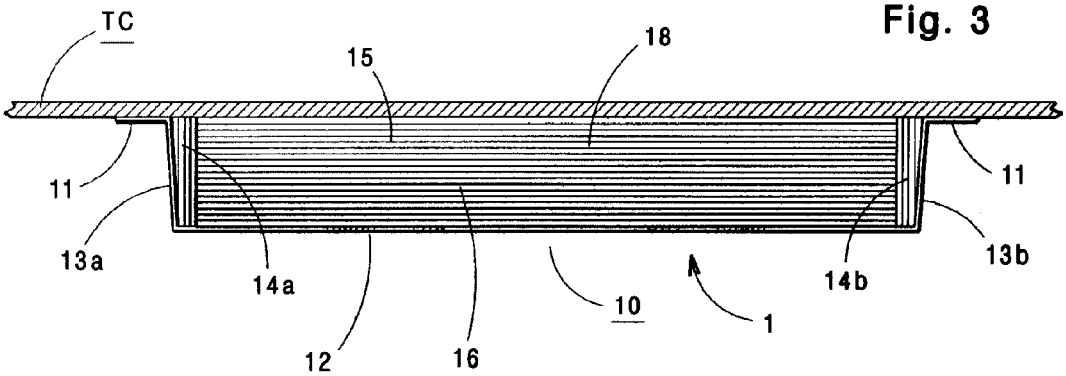
FIG. 3 is a top plan view of the caddy shown in FIG. 2.

Referring to FIGS. 1 through 3, the drawings show the combination holder and trashcan liner dispenser comprising a retrofit caddy and liner cartridge 1 of the preferred embodiment fastened to a surface of a trashcan "TC" or the like. The caddy comprises a U-shaped flange 11, a front panel 12, and a pair of sidewalls 13*a* and 13*b* that extend outward from a U-shaped flange 11 to the front panel 12, and each sidewall includes an integral lock pin 14*a* and 14*b* respectively. Front panel 12 extends between the sidewalls and includes a sloped bottom end portion 15 between the sidewalls 13*a* and 13*b* that provides a closed end 16 opposite open end 17.

Figure 4:
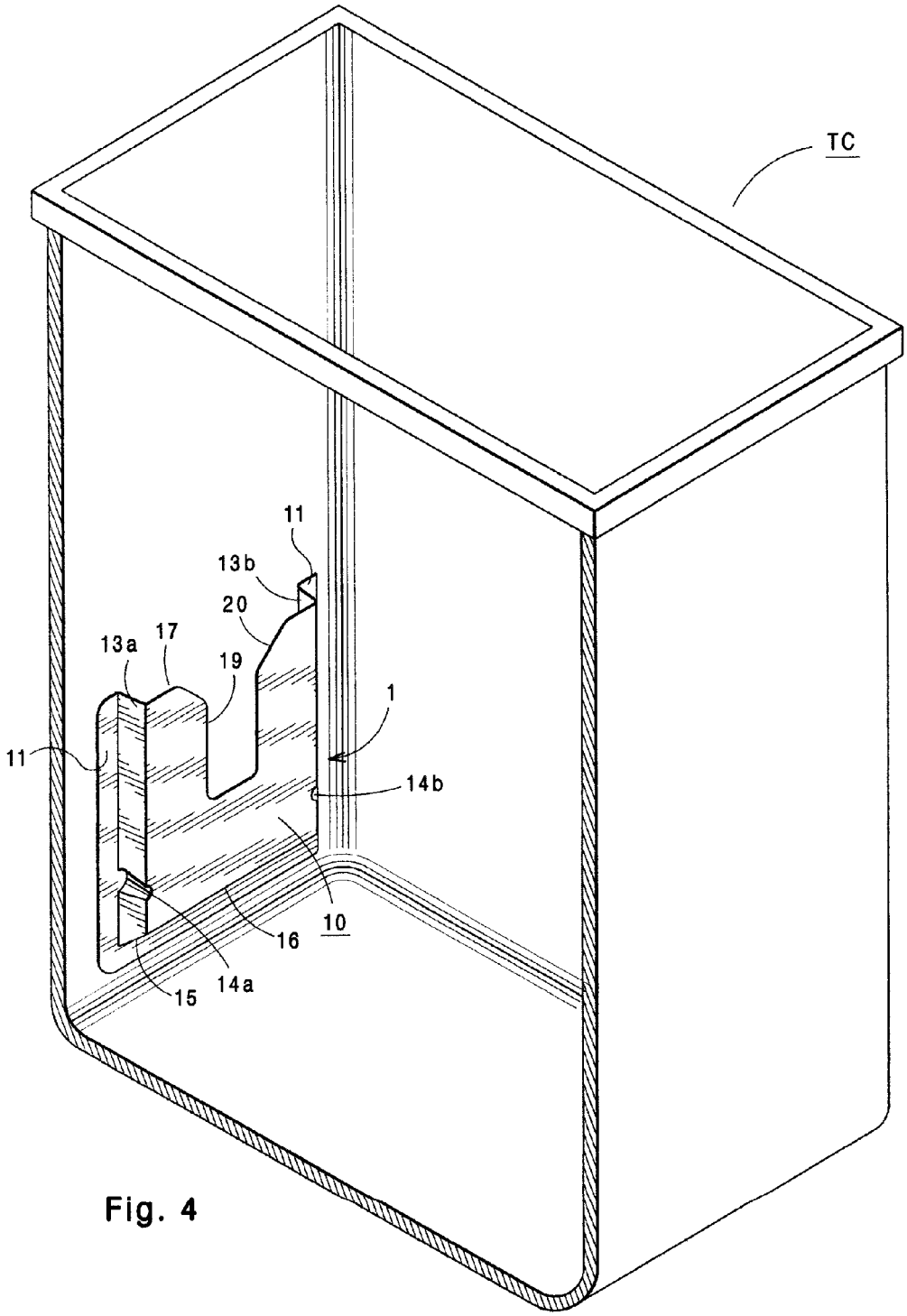
FIG. 4 shows the caddy of the present invention fixed to an inside surface of a trash container.
Figure 5:
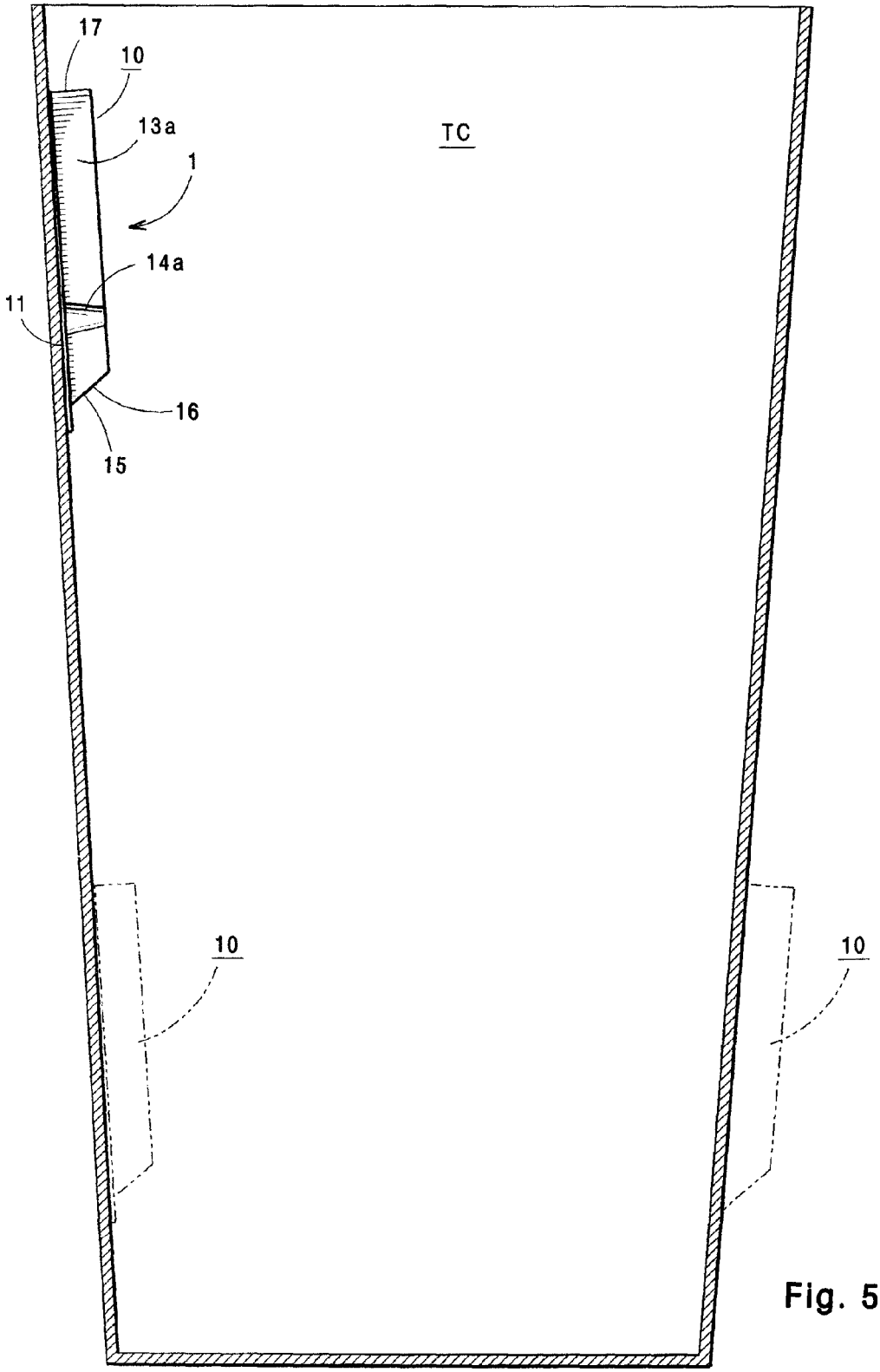
FIG. 5 shows the caddy of the present invention fixed at various surface locations of a trash container.

Referring in particular to FIG. 2 showing a back elevation view of caddy 10; the back surface of the U-shaped flange 11 includes an adhesive fastening means comprising a double sided adhesive strip 21 with a removable protective cover 22 that is removed to fix the caddy 10 to a selected surface of a trashcan. Preferably caddy 10 is fixed to an inside surface of the trash receptacle as shown in FIG. 4. However, as illustrated in FIG. 5, the caddy may be fixed to any interior or exterior surface of a trashcan that is most convenient to an individual user without departing from the scope of the present invention. In addition, caddy 10 could be fixed to a convenient surface adjacent the trashcan, for example the inside of a kitchen cabinet, without departing from the scope of the present invention. Referring again to FIG. 2, the caddy 10 may be fixed to a selected surface of a trashcan or the like with fasteners inserted through apertures 23 provided in the U-shaped flange 11.

Referring to FIGS. 1-12, the structure formed by the combination front panel 12, the two sidewalls 13*a* and 13*b*, and the sloped bottom panel 15 provides a pouch or chamber 18 extending between the open end 17 and closed end 16 of the caddy, the pouch is shaped to receive and hold the liner cartridge portion 30 of the present invention. Front panel 12 includes an elongated notch 19 that extends from the open end 17 in a downward or longitudinal direction. Notch 19 includes a flared upper end 20 that communicates with the open end 17 of pouch 18 and the notch is positioned to expose a liner access opening 39 through which folded trash liners 51 are pulled from the cartridge.

Sidewalls 13*a* and 13*b* are spaced apart at a distance that corresponds with the width of liner cartridge 30 defined by the distance between the cartridge sidewalls 35 and 36 so that each inward extending lock pin 14*a* and 14*b* is positioned to align with a corresponding perforated retainer slot 35*a* and 36*a* provided in sidewalls 35 and 36. The combination lock pins and retainer slots provide a self-locking mechanism that prevents withdrawal of the liner cartridge 30 from pouch 18 when a liner is pulled from the cartridge through the liner access opening 39. When the liner cartridge is inserted into pouch 18, each of the opposed lock pins 14*a* and 14*b* tear open its respective perforated retainer slot 35*a* and 36*a* and penetrates each cartridge sidewall 35 and 36 to fix or lock liner cartridge 30 between the spaced apart sidewalls 13*a* and 13*b* of the caddy. The penetrating lock pins 14*a* and 14*b* neither contact nor interfere with pulling a liner from the interlocked cartridge.

Figure 6:
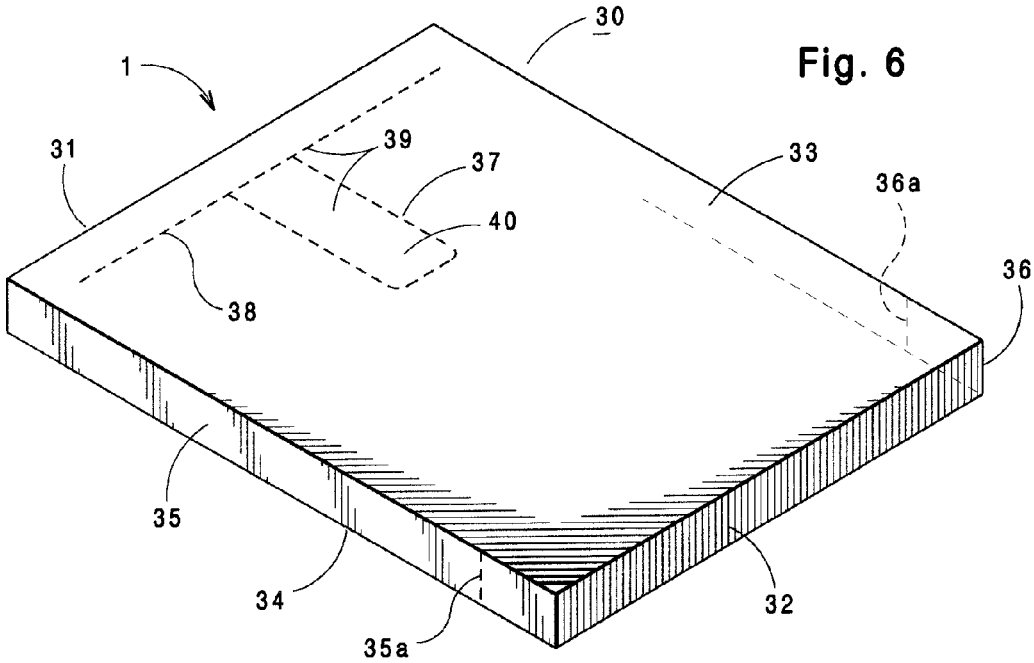
FIG. 6 is an isometric view showing the preferred embodiment of the cartridge shown in FIG. 1.
Figure 7:
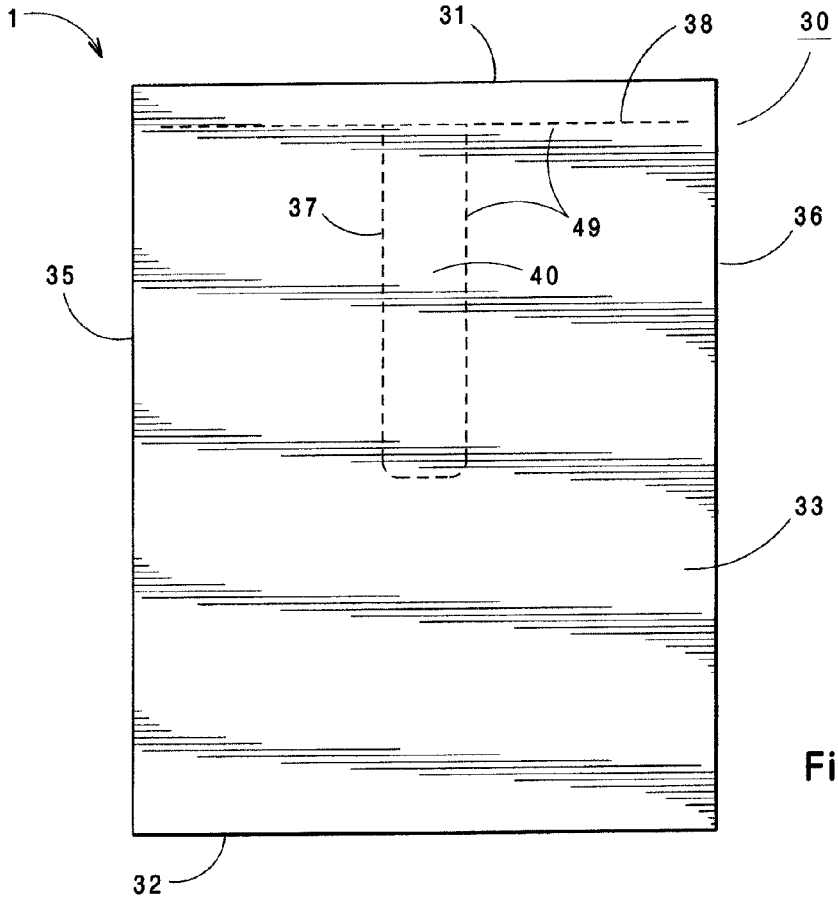
FIG. 7 is a front elevation view of the cartridge shown in FIG. 6.
Figure 11:
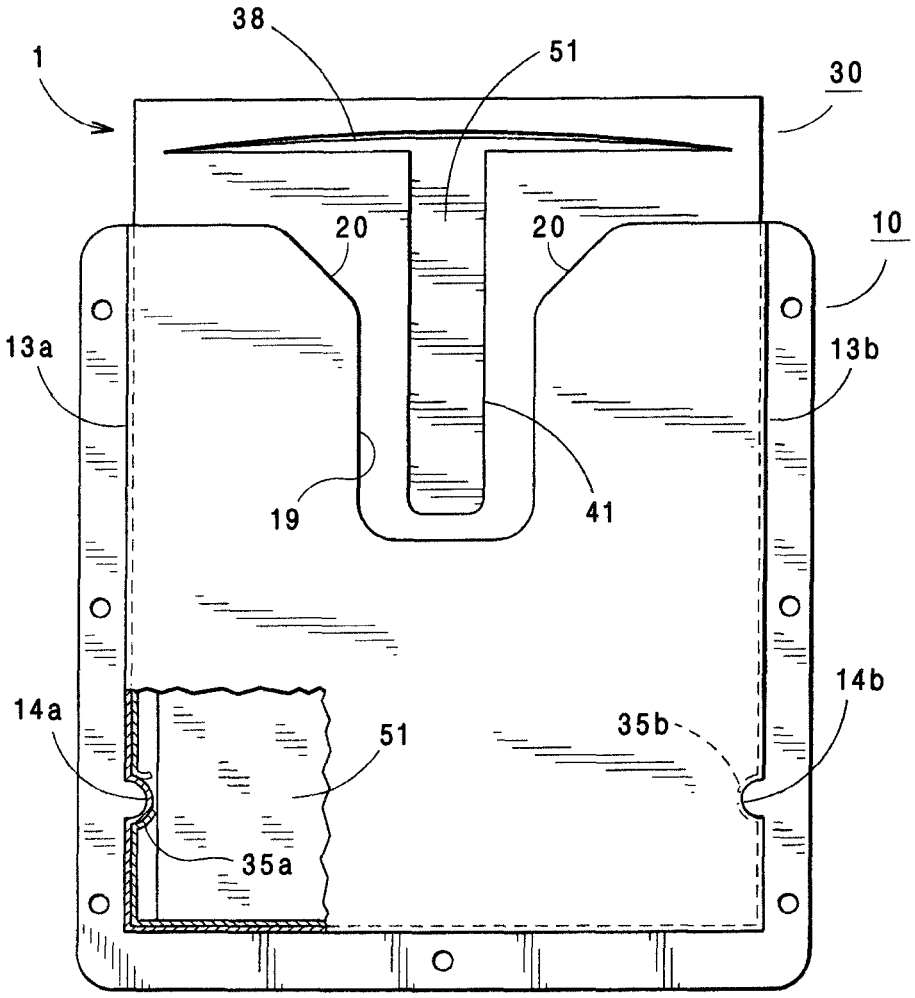
FIG. 11 is a partial cross-sectional view similar to FIG. 1 showing the liner cartridge of the present invention inserted into the caddy with a lock pin fixing the cartridge within the pouch portion of the caddy.
Figure 12:
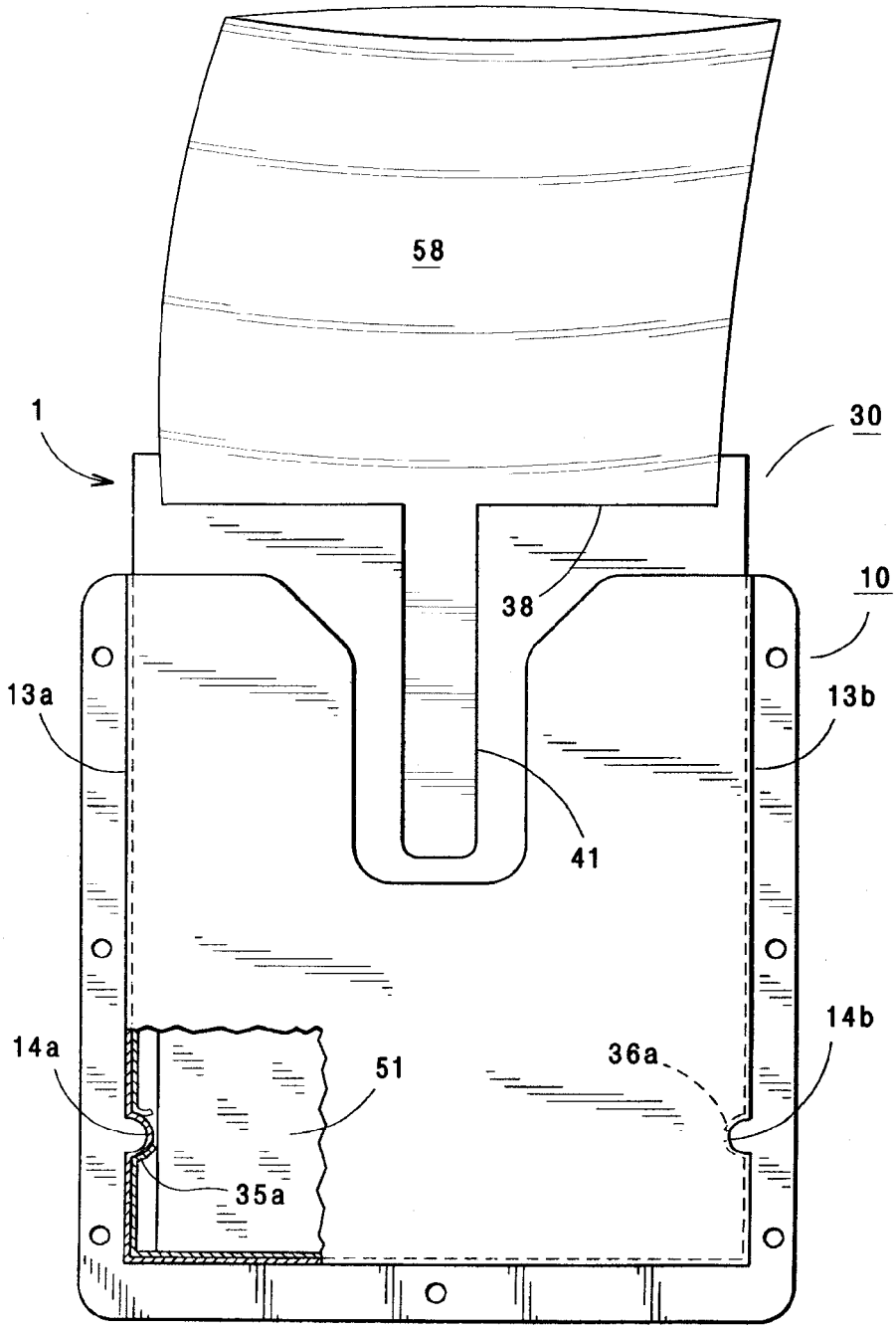
FIG. 12 is a front elevation view of the combination caddy and liner cartridge showing the open end of a liner being withdrawn from the cartridge through the access opening.

Referring specifically to FIGS. 6 and 7, cartridge 30 is shaped to nest within the pouch portion of the caddy and comprises a closed container having a top panel 31, a bottom panel 32, a front panel 33 opposite a back panel 34, and sidewalls 35 and 36. The front and back panels 33 and 34 have a width that corresponds with the distance between the sidewalls 13*a* and 13*b* of pouch 18 formed in the caddy 10 so that liner cartridge 30 fits between the side walls of the pouch. Front panel 33 includes a longitudinal perforated notch 37 that extends along a length portion of the front panel 33 and the perforated notch intersects a transverse perforated slit 38 that extends along a width portion of the front panel. The perforated notch and slit define a liner access opening 39. When the perforations along the notch 37 and slot 38 are broken and the notch portion 40 of opening 39 is removed from the front panel 33. When the perforated portions are broken and removed from cartridge 30, the opened notch 41 (FIGS. 11 and 12) enables a user to grasp a suspended liner 51 positioned adjacent the access opening 39 and the grasped liner is pulled from cartridge 30 through the transverse opened slot 38. The broken or opened perforated slot 38 has an opening width that is equal to or greater than the width of the folded suspended liners 51 so that each liner can be pulled from cartridge 30 with a pulling force that is less than a tension force needed to break the self-locking mechanism that fixes cartridge 30 within the pouch or pouch chamber 18.

Tests were conducted using a JONARD GPP-15 Push/Pull Force Gage to determine the force required to break the self-locking mechanism and withdraw the liner cartridge from pouch 18. A second test was conducted to establish the pulling force needed to pull a liner from a cartridge interlocked with the penetrating caddy lock pins. A final test was conducted to verify the pull force required to withdraw a liner cartridge from pouch 18 when the lock pins do not penetrate the cartridge sidewalls, where the lock pins only clasp or grip the cartridge similar to the clasp arrangement taught in U.S. Pat. No. 4,850,507 granted to Lemongelli, on Jul. 25, 1989 which was cited by the examiner during examination of our co-pending application Ser. No. 12/191,241 filed Aug. 13, 2008. The following Table "A" lists the force test results.

TABLE A

| | LOCK PINS PENETRATING CARTRIDGE PULL FORCE | LOCK PINS CLASPING CARTRIDGE PULL FORCE | LOCK PINS PENETRATING LINER PULL FORCE |
|---|---|---|---|
| Pull Force | 5 pounds | 3.5 pounds | 2 pounds |

A supplemental test was conducted after the above first three tests were conducted. In this test, we measured the force required to pull trash bags from a box (a cartridge) of Hefty® trash bags or liners which are currently available in the marketplace. The pull test showed that such available trash bag packages require between about 3.0 to 3.5 pounds of force to pull the trash bags through the opening provided in the packaging. Such high pull forces will remove a clasped cartridge, as taught by Lemongelli, from its holder or caddy, before the trashcan liner is pulled free from the cartridge.

The test results show that the tension break force required to break the self-locking mechanism is about 2.5 times greater than the pulling force required to pull a liner from the cartridge thereby eliminating or reducing accidental removal of the cartridge from the caddy. The tests results further show that the present self-locking mechanism provides a cartridge holding power improvement of about 1.4 times greater than the clasping force provided by the Lemongelli patent.

Referring to FIGS. 8-12, the interior or closed space 50 of the liner cartridge 30 houses a plurality of replacement liners 51 folded along both the liner length and width to fit the interior space 50, the liner width being folded to be equal or less than the slit 38 width in the front panel 33 of the cartridge. The plurality of folded replacement liners 51 is hung from a support member 52. The support member is a U-shaped member comprising a first support leg 53 and a second support leg 54 extending from a base 55 to a location between the top panel 31 and the perforated slot 38 provided in the front panel of cartridge 30. Base 55 is positioned on, or attached to, the cartridge bottom panel 32, and the width of the support legs 53 and 54, extending in a direction between the sidewalls 35 and 36 of the cartridge proximate the width of the perforated slot 38.

The replacement liners 51 are folded and draped along their lengths over the support legs 53 and 54 in an arrangement of fourths whereby the first of the four lengths, in this instance the open end 58 of the liner, is suspended from the first support leg 53 at a location between leg 53 and the front panel 33 of cartridge 30 adjacent access opening 39. The belly portion 56 of the liner is suspended from and in-between both support legs 53 and 54. And finally, the last fourth length of the liner or closed end 59 is suspended from the second support leg 54 at a location between leg 54 and the back panel 34 of cartridge 30. It should be understood, however, that the locations of the open end 58 and the closed end 59 may be switched or reversed without departing from the scope of the present invention. Support member 52 prevents the suspended or draped supply of liners from slumping or falling toward the bottom panel 32 of the liner cartridge, and maintains the first fourth or quarter length of the suspended liners at a position adjacent the perforated notch 37 and perforated slot 38 for easy liner withdrawal from cartridge 30 after the appropriate perforated portions of the access opening 39 are broken and removed as described above.

More importantly, because each folded liner in the liner supply 51 is draped over or suspended from the support legs 53 and 54 in the described arrangement of fourths, and because the first fourth length of the liner 58 is positioned adjacent the access opening 39, only one quarter of the liner at a time resists the pulling force when a liner is pulled from the cartridge. For example, when a liner is removed from cartridge 30, the first fourth length 58 of the liner is grasped along notch 37 in the front panel and liner is pulled in an upward direction along notch 39 and then through the bisected slit 38 until length 58 is pulled free from the cartridge. Resistance to the applied pulling force is then transferred from the first length to the belly portion 56 of the liner followed by a transfer of pulling force resistance to the last fourth length 59 of the liner after the belly portion 56 is pulled from cartridge through slit 38. In other words, the pulling force is sequentially applied to successive one quarter lengths of the liner being withdrawn from the cartridge. Therefore, the draped or suspended arrangement of fourths reduces the liner pulling force by approximately in half when compared to the force required to pull an entire liner length from a cartridge or box. This is a significant improvement over prior art devices, and in particular, it is a major improvement when compared to the container and bag arrangement disclosed in UK Patent Application GB 2 079 249 A where the pulling force is applied to the entire bag when it is removed from the container. In addition, the British reference also discloses pulling the bag through a container access opening that is less than one half of the width of the bags stored in the container. The small size opening will further increase the pulling force needed to withdraw the bag from the container. The reduced pulling force provided by the present invention, where the liners are suspended in an arrangement of fourths, in combination with the high cartridge holding power provided by the self-locking mechanism, decreases the likelihood that the cartridge will be accidently withdrawn from the pouch when liners are pulled from the cartridge.

In addition, support legs 53 and 54 may be biased toward the front and back panels 33 and 34 of cartridge 30 so that when a liner is pulled from the cartridge, the open end portion 58 of the next liner is positioned against or within close proximity of the opened notch 41 to facilitate easy grasping and removal of the next liner from the cartridge. FIG. 10 shows that even when there is only one liner 51 remaining in the cartridge, the biased support legs position that last liner adjacent the open notch 41 for easy removal.

It should be understood that, although the drawing figures show a U-shaped support member 52, any suitable support member shape, for example a V or W-shaped, may be used without departing from the scope of the present invention as long as such shaped support member is capable of maintaining suspended liner adjacent the opened notch 41 to facilitate easy removal of the liners.

As such, an invention has been disclosed in terms of preferred embodiments and alternate embodiments thereof, which fulfills each one of the objects of the present invention as set forth above and provides a waste management system that includes a combination trashcan, pouch, and cartridge removably fixed within the pouch and containing a supply of replacement liners that are always supported at a position for easy access and removed from the cartridge. Of course, various changes, modifications, and alterations from the teachings of the present invention may be contemplated by those skilled in the art without departing from the intended spirit and scope thereof. It is intended that the present invention only be limited by the terms of the appended claims.

The invention claimed is:

1. A trashcan liner dispenser, comprising:

a) a caddy shaped to provide a pouch defined by a front panel, a first pouch sidewall, a second pouch sidewall, and an open top end opposite a closed bottom end, b) a cartridge shaped to nest within said pouch, said cartridge containing a supply of folded trashcan liners housed therein and c) a self-locking mechanism comprising, i) a first lock pin positioned within said pouch, ii) a second lock pin positioned within said pouch, iii) a first perforated retainer slot provided along a surface of said cartridge and positioned to engage said first lock pin when the cartridge is inserted into said pouch, and iv) a second perforated retainer slot provided along a surface of said cartridge and positioned to engage said second lock pin when the cartridge is inserted into said pouch;

whereby said first lock pin and said second lock pin are each shaped to tear open and self-lock within said first perforated retainer slot and said second perforated retainer slot of an inserted cartridge, said first self-locked pin and said second self-locked pin each positioned within said inserted cartridge at a location that neither contacts the supply of folded liners nor interferes with a liner that is pulled from said supply of folded liners through an access opening provided in the inserted cartridge.

2. The trashcan liner dispenser recited in claim 1, whereby: a tension break force required to disengage the inserted cartridge from said first self-locked pin and said second self-locked pin is greater than a force required to pull a trashcan liner from said inserted cartridge.

3. The trashcan liner dispenser recited in claim 2, whereby: said tension break force is greater than 3.5 pounds.

4. The trashcan liner dispenser recited in claim 2, whereby: said tension break force is about 5 pounds.

5. The trashcan liner dispenser recited in claim 2, whereby: said tension break force required to break the inserted cartridge free is about 2.5 times greater than a pulling force required to pull a liner from the inserted cartridge.

6. The trashcan liner dispenser recited in claim 5, whereby: said first support leg is biased toward said front panel.

7. The trashcan liner dispenser recited in claim 5, whereby: said first support leg is biased toward said front panel and said second support leg is biased toward said back panel.

8. The trashcan liner dispenser recited in claim 1, whereby said cartridge comprises:

a) a liner access opening on a front panel of the cartridge, said access opening including a perforated notch that extends in a longitudinal direction along said front panel and a perforated slit that extends in a transverse direction along said front panel, said perforated slit bisected by the perforated notch, and b) a support member housed within said cartridge, said support member comprising a first support leg opposite a second support leg on which said supply of folded trashcan liners is draped in an arrangement of fourth lengths so that a first end of the folded supply of liners is suspended between the first support leg and said front panel and is positioned adjacent said liner access opening, a second end of the folded supply of liners is suspended between the second support leg and a back panel of the cartridge, and a belly portion of the folded supply of liners is suspended between said first support leg and said second support leg;

whereby the draped arrangement of fourth lengths, in combination with said access opening, causes a pulling force to be sequentially applied to each successive fourth length of a liner withdrawn from the cartridge through said slit portion of the access opening.

9. A trashcan liner cartridge, comprising:

a) at least two perforated retainer slots provided along a surface of said trashcan liner cartridge, b) a liner access opening located along a front panel of the trashcan liner cartridge and comprising a vertical notch that bisects a horizontal slit, and c) a support member housed within said trashcan liner cartridge, said support member including a supply of folded liners suspended along their lengths on said support member in an arrangement of fourths lengths so that a first fourth length of said folded liners is positioned adjacent said liner access opening, whereby said supply of folded trashcan liners in combination with said access opening causes a pulling force to be sequentially applied to each successive liner fourth length as a liner is pulled from said supply of folded liners through said horizontal slit portion of the access opening.

10. The trashcan liner cartridge recited in claim 9, whereby: said support member includes a first support leg is biased toward said front panel access opening.

11. The trashcan liner cartridge recited in claim 9, whereby: said support member includes a first support leg is biased toward said front panel access opening and a second support leg biased toward a back panel positioned opposite said first panel access opening.

* * * * *